United States Patent [19]

Miller

[11] Patent Number: 5,045,012

[45] Date of Patent: Sep. 3, 1991

[54] RECONFIGURABLE TOY GLIDER

[76] Inventor: Jack V. Miller, 700 N. Auburn Ave., Sierra Madre, Calif. 91024

[21] Appl. No.: 512,769

[22] Filed: May 17, 1990

[51] Int. Cl.[5] ..... A63H 27/00; A63H 3/46; A63H 33/00

[52] U.S. Cl. ..... 446/62; 446/376; 446/487

[58] Field of Search ..... 446/62, 66, 67, 376, 446/487, 470, 471, 465, 431, 94, 95, 478

[56] References Cited

U.S. PATENT DOCUMENTS

| | | | |
|---|---|---|---|
| 2,354,392 | 7/1944 | McCoy | 446/94 X |
| 3,408,767 | 11/1968 | Anderson | 446/62 |
| 4,484,406 | 11/1984 | Matsumoto et al. | 446/487 |
| 4,680,022 | 7/1987 | Hoshino et al. | 446/487 |
| 4,744,781 | 5/1988 | Ostendorff et al. | 446/465 X |
| 4,863,413 | 9/1989 | Schwarz | 446/62 |
| 4,915,664 | 4/1990 | Bakker | 446/62 |
| 4,988,320 | 1/1991 | Rankin et al. | 446/62 |

FOREIGN PATENT DOCUMENTS

| | | | |
|---|---|---|---|
| 2151149 | 7/1985 | United Kingdom | 446/487 |

*Primary Examiner*—Robert A. Hafer
*Assistant Examiner*—D. Neal Muir

[57] ABSTRACT

A toy glider has an elongated fuselage having a longitudinal axis in the normal horizontal flight attitude, a nose section and a tail section having airfoil portions in horizontal and vertical planes. The fuselage includes a trapezoidal portion with non-parallel sides forming wing root fairings at an angle to the longitudinal axis for mounting a pair of wings having wing roots at an angle to a wing span axis, and pivotal on the wing root fairings. The wings may be extended into normal flight position and may also be pivoted into a retracted position parallel to the longitudinal axis. In a preferred embodiment the nose section simulates a head, and the vertical tail portions simulate feet, providing the appearance of an animal figure. The glider has the aft edges of the tail section in a vertical, transverse plane, whereby the glider can stand on its tail in an erect, standing posture, and the aft edges of the vertical tail portions also include wheels so the erect glider may also be rolled on the wheels. The tail is depending with wheels below the fuselage in the horizontal orientation. The nose pivots downward and also includes a wheel, so the glider may land on wheels or roll with wings retracted as a toy automobile. With the nose section and wheel elevated, the glider also simulates a toy boat.

9 Claims, 5 Drawing Sheets

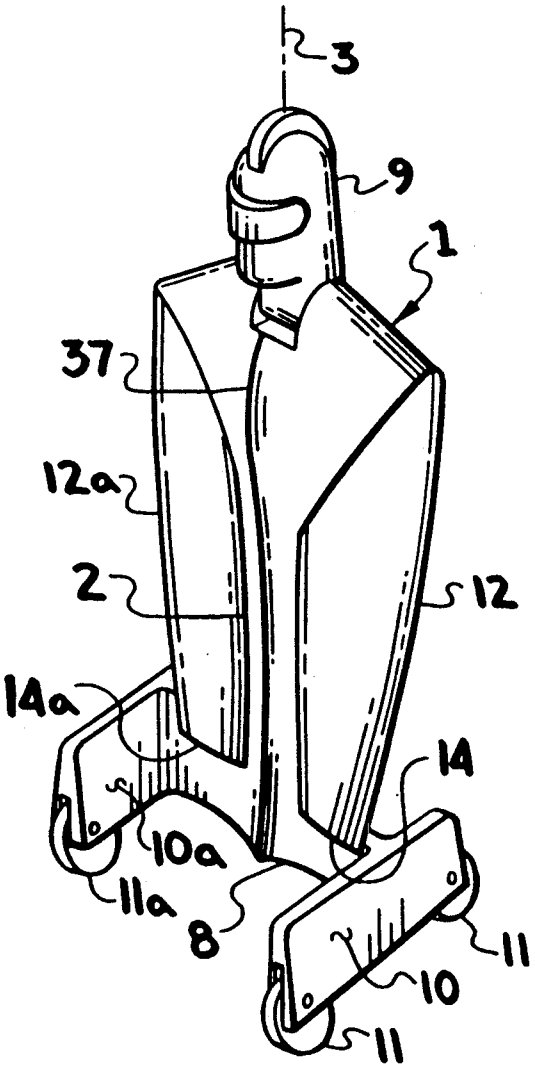
FIG. 3
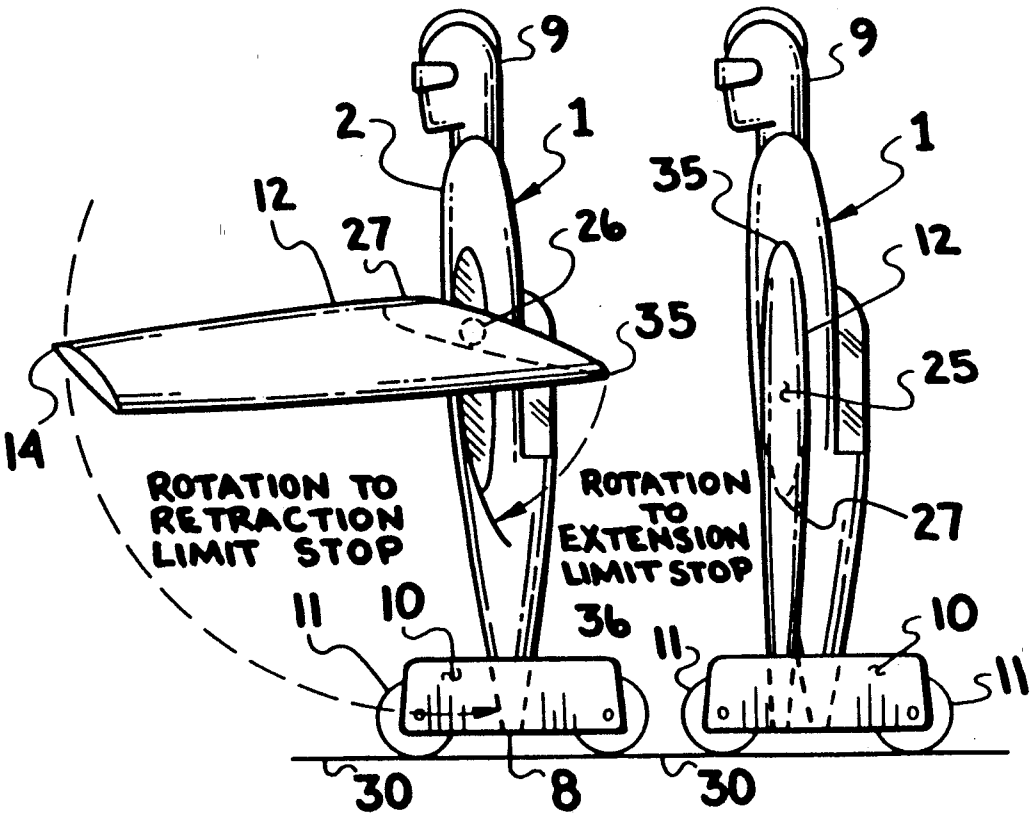
FIG. 4
FIG. 5

RECONFIGURABLE TOY GLIDER

BACKGROUND OF THE INVENTION

A primary purpose of the present invention is to provide a toy glider that is reconfigurable into various positions that are typical of animal, humanoid, robot, automibile and boat play activities, thereby providing greatly enhanced play value for a toy glider. Toy gliders as presently known are simply launched, glide a distance and then land. The play value lasts only a few seconds, and is generally restricted to outdoor use. My co-pending invention for a reconfigurable animal figure toy glider, Ser. No. 07/331,744, now U.S. Pat. No. 4,988,320, that may be used in play that extends to the limits of a child's imagination. The primary purpose of the present invention is to provide a more versatile toy glider that is not only reconfigurable into animal forms, but is also reconfigurable into a toy car and boat.

SUMMARY OF THE INVENTION

The foregoing purposes of the invention are achieved by the present invention by providing a transformable toy glider comprising an elongated fuselage having a generally horizontal longitudinal axis when said toy glider is in an attitude of normal flight. The fuelage includes a nose section and a tail section having generally in the horizontal and vertical planar airfoils parallel to the longitudinal axis. The tail section airfoils have aft and tip edges which include rollable wheels. The fuselage inclues a portion of generally trapezoidal form in a horizontal plane, having its parallel sides in the form of vertical planes which are bulkhead sections transverse to the longitudinal axis of the fuselage, with the non-parallel sides of the trapezoid forming wing root fairings at an angle to the longitudinal axis of the fuselage. The wing root fairings are adapted for the pivotal mounting of a pair of wings. The wings are attached to the fuselage and with aerodynamic chords in the horizontal plane in normal flight attitude. Each wing has a span axis through the vertical planar wing root at the inboard end. The wing roots are pivotally attached to the fuselage in abuttment with the wing root fairings comprising the non-parallel portions of the trapezoidal portion of the fuselage. A first rotational limit stop or detent for each wing is provided, in which the angle of the wing root and the angle of the fuselage wing root fairing are added to orient the span axis of the wings into a generally extended flight position normal to the longitudinal axis of the fuselage, wherein and the wing airfoils chords are in the horizontal plane and parallel to the longitudinal axis. A second rotational limit stop for each wing is approximately 180° from said first limit stop position, in which the angle of the wing root and the angle of the fuselage wing root fairing are subtracted to orient the span axis of the wings in a retracted position, wherein the span axis is of each wing is generally parallel to the longitudinal axis of the fuselage and the wing airfoils chords are in the horizontal plane and transverse to the longitudinal axis.

In a preferred embodiment at least one vertical portion of the tail section has a depending tip edge, whereby the glider may be placed on a horizontal surface and is partially supported by said depending tip edge of the tail empennage. In the preferred embodiment the nose section is hingedly attached to the fuselage about a hinge axis in the horizontal plane and transverse to the longitudinal axis of the fuselage, whereby said nose section may be rotated in the downward direction about the hinge axis to depend below the fuselage, whereby the glider may be placed on a horizontal surface and be partially supported by said depending nose section. Therefore the glider in a normal horizontal flight attitude may be placed on a horizontal surface and be supported by the depending nose section and tail empennage. In a preferred embodiment the tip of each depending vertical portion of the tail section and the depending nose section have wheels whereby the glider may be rolled on a horizontal surface, such as a table or floor.

Also, the aft edges of the vertical and horizontal airfoil portions of the tail section form a plane normal to the longitudinal axis, whereby the glider may be placed on a horizontal surface with the longitudinal axis of the glider vertical. Also, the aft edges of the vertical airfoil portions of the tail section are also provided with a wheels whereby the glider may be rolled on a horizontal surface with the longitudinal axis of the glider being vertical.

In a preferred embodiment the fuselage is provided with a simulated cabin on an upper surface, and is further provided with simulated boat hull contours on a lower surface. In another preferred embodiment the vertical plane tail airfoil portions are in the general form of biped humanoid or animal feet, and the nose section is in the general form of a humanoid or animal head.

BRIEF DESCRIPTION OF THE DRAWINGS

FIG. 3 is a perspective view of the toy glider of FIG. 2 with the wings retracted, shown in the form of a standing biped figure rollable on a horizontal surface;

FIG. 4 is a side elevation view of the toy glider of FIG. 3, with the wings retracted;

FIG. 5 is a side elevation view of the toy glider of FIG. 3, with the wings partially extended;

DETAILED DESCRIPTION OF THE DRAWINGS

Figure 1:
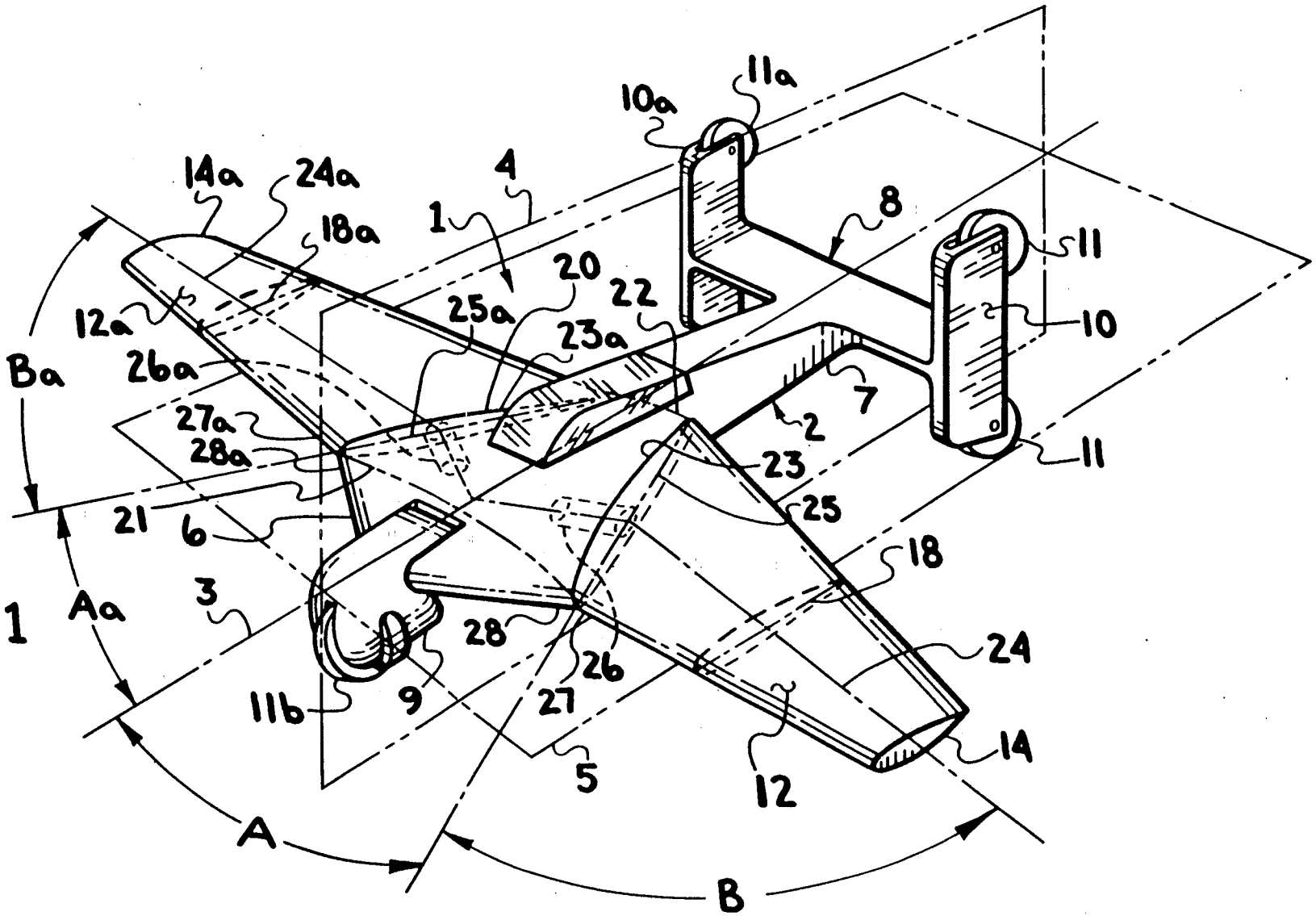
FIG. 1 is a perspective view of a reconfigurable toy glider according to the present invention with the wings extended in a flying configuraton.

In FIG. 1 the toy glider 1 according to the invention is shown in a normal level flying configuraton in which a fuselage 2 is elongated along a flight axis 3 through which pass a vertical plane 4 and a horizontal plane 5, said fuselage having a front end 6 adapted for attachment of a nose section 10, and a rear end 7 adapted for attachment of a tail section horizontal airfoil 8 and vertical airfoils 10 and 10*a*. The vertical airfoils 10 and 10*a* are provided with wheels 11 and 11*a*, respectively, in a plane transverse to the longitudinal axis 3. Another wheel 11*b* is provided in nose section 9. Fuselage 2 is adapted on each side of the vertical plane for the attachment of a pair of wings 12 and 12*a*, said wings being generally planar and disposed generally in the horizontal plane 5 and being provided with areas with cross-sectional airfoil shapes 14 and 14*a*, respectively, and having their areodynamic chords 18 and 18*a*, respectively, configured for flight. Fuselage 2 has a generally trapezoidal section 20 having parallel sides 21 and 22 and symmetrical non-parallel sides 23 and 23*a* in the form of generally vertical planes at an angle A and Aa, respectively with axis 3. Wings 12 and 12*a* have wing root 25 and 25*a*, respectively at an angle B and Ba, respectively, from the span axis 24 and 24*a*, wherein angle A and B are complementary (adding up to 90°) and angles Aa and Ba are also complementary. Wings 12 and 12*a* are pivotable about shafts 26 and 26*a*, respectively, and may be pivoted from a first limit stop or position detent in the extended-wing position to a second limit stop or position detent in the retracted position.

Figure 2:
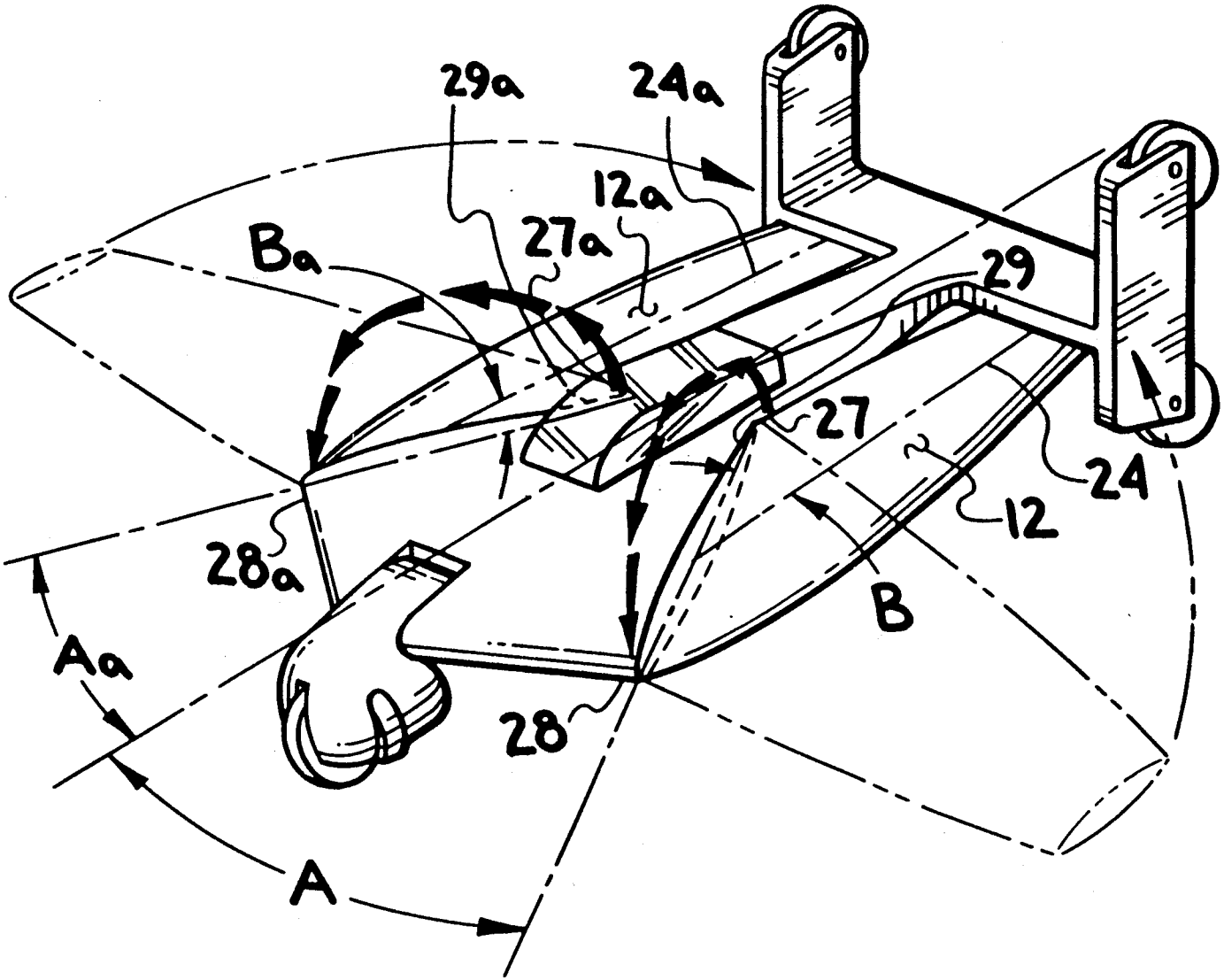
FIG. 2 is a perspective view of the toy glider of FIG. 1 with the wings retracted into a non-flying configuration.

In FIG. 2 the toy glider 1 of FIG. 1 is shown with the wings 12 and 12*a* pivoted from the extended postion at the first limit stop (shown in phantom lines) to the second limit stop or detent position in which the wings are retracted. wherein angles A and B are supplementary (adding to 180°) and angles Aa and Ba are also supplementary, and span axes 24 and 24*a* are thereby postioned parallel to the longitudinal axis of the fuselage.

In FIG. 1 the leading edge 27 of left wing root 25 is adjacent to the leading edge 28 of the left vertical plane 23, and the leading edge 27*a* of left wing root 25*a* is adjacent to the leading edge 28*a* of the left vertical plane 23*a*. The wings are rotated about pivots 26 and 26*a*, respectively, between FIGS. 1 and 2. In FIG. 2 the leading edge 27 of left wing root 25 is rotated to the trailing edge 29 of the left vertical plane 23, and the leading edge 27*a* of left wing root 25*a* is rotated to the trailing edge 29*a* of the left vertical plane 23*a*.

In FIG. 3 the glider of FIG. 2 is shown standing on wheels 11 and 11*a* in vertical airfoils 10 and 10*a*, respectively on horizontal tail airfoil 8. The vertical airfoils 10 and 10*a* are generally configured to represent feet of an animal or humanoid figure standing in a biped position on a generally horizontal surface, and the wheels, 11 and 11*a* are rollable. Fuselage 2 is supported from horizontal tail airfoil 8 with its axis 3 (horizontal axis in normal horizontal flight) vertical. A ridge 26 extends substantially for the length of the fuselage, representing in part an animal sternum. On either side of fuselage 2 are the wings 12 and 12*a*, having wing tips 14 and 14*a* at a retraction limit stop position against horizontal tail airfoil 8.

In FIG. 4 glider 1 is shown supported on wheels 11 of vertical airfoils 10 and 10*a*, permitting the glider in an erect, biped posture to roll on a generally flat, horizontal surface 30.

In FIG. 5 glider 1 is also shown supported on wheels 11 of vertical airfoils 10 and 10*a*, permitting the glider in an erect posture to roll on a generally flat, horizontal surface 30. On either side of fuselage 2 are the wings 12 and 12*a*, having wing tips 14 and 14*a* extended by rotation to away from the retraction limit stop position against horizontal tail airfoil 8 to a position perpendicular to fuselage 2.

The trailing edge 35 of wing root 25 is shown rotated clockwise from the retracted position of FIGS. 2–4 to the transverse position if FIG. 5. Trailing edge 35 follows the path of the arrow identified as ROTATION TO EXTENSION LIMIT STOP until it strikes extension limit stop 36, with in the wing extended. Conversely, rotation of the wing in the counter-clockwise direction from the position shown in FIG. 5 causes wing tip 14 to follow the path of the arrow identified as ROTATION TO RETRACTION LIMIT STOP until it strikes the horizontal tail airfoil 8, with the wing retracted.

Figure 6:
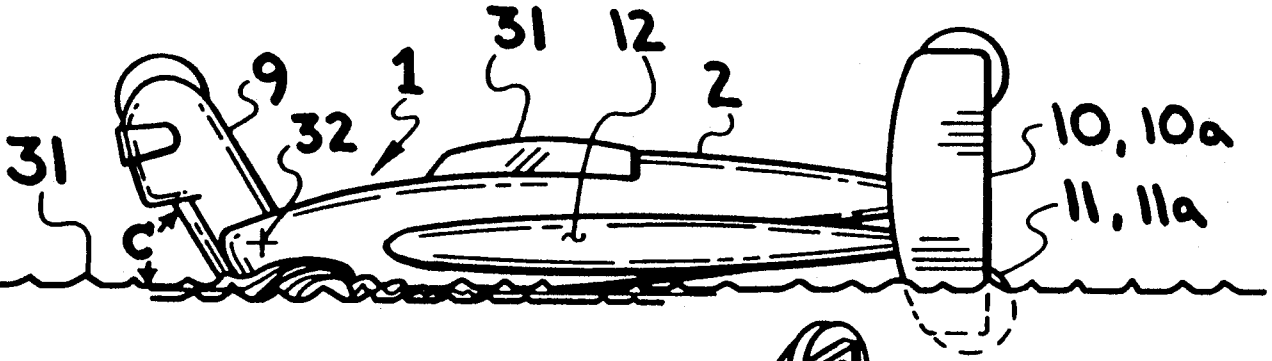
FIG. 6 is a side elevation view of the toy glider of the present invention with the wings retracted and shown in the form of a toy boat floating on water.

In FIG. 6 glider 1 is shown in a side elevation view having fuselage 2 and depending portions of vertical airfoils 10 and 10*a* floated on a water surface 31. whereby wheels 11 and 11*a* are substantialy submerged. Wings 12 and 12*a* are in the retracted position, and nose section 9 is pivoted upward on a transverse axis 32 to an acute angle C providing a prow for the glider in use as a toy boat. Fuselage 2 is also provided with a simulated cabin 31.

Figure 7:
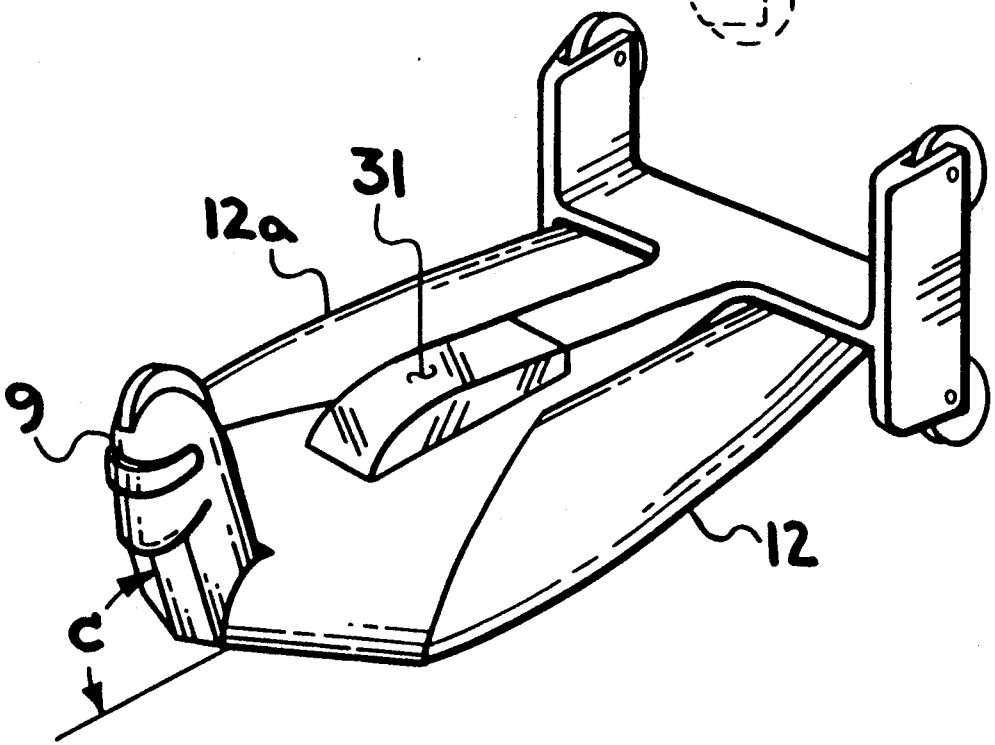
FIG. 7 is a perspectie view of the toy glider of FIG. 6 shown in the form of a toy boat

In FIG. 7 glider 1 of FIG. 6 is shown in a perspective view in which nose section 9 is pivoted on a transverse axis 32 to acute angle C providing a prow for the glider in use as a toy boat. Fuselage 2 is also provided with a simulated cabin 31.

Figure 8:
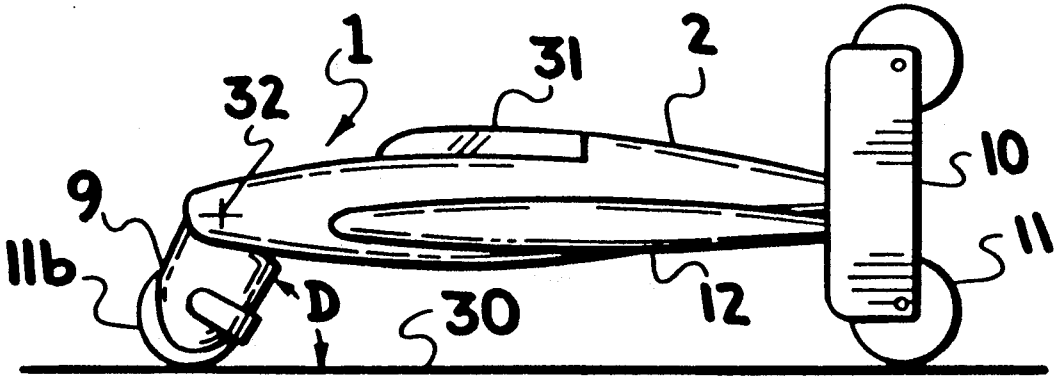
FIG. 8 is a side elevation view of the toy glider of the present invention with the wings retracted and shown in the form of a toy automobile rollable on a flat horizontal surface.

In FIG. 8 glider 1 is shown in a side elevation view having fuselage 2 and depending portions of vertical airfoils 10 and 10*a* on a flat, horizontal surface 30, such as a table or floor, whereby wheels 11 and 11*a* are in rollable contact with horizontal surface 30 in the manner of a toy automobile. Wings 12 and 12*a* are in the retracted position, and nose section 9 is pivoted downward about transverse axis 32 to an acute angle D providing a front wheel 11*b* in rollable contact with surface 30 for the glider in use as a toy automobile. Fuselage 2 is also provided with a simulated cabin 31.

Figure 9:
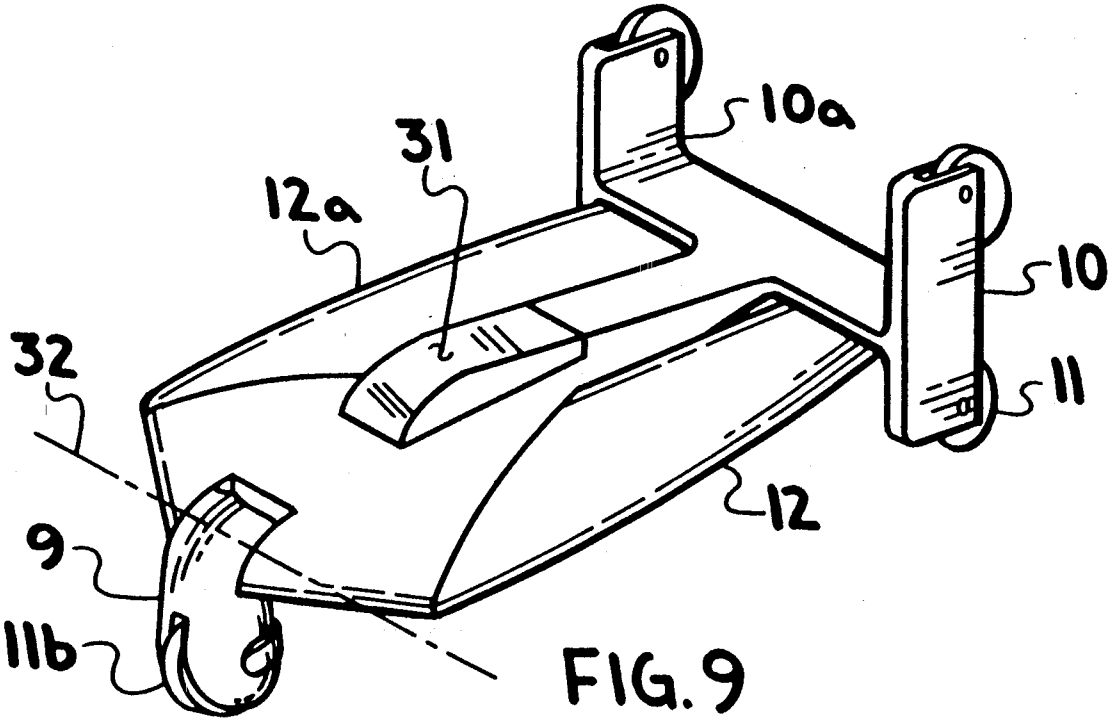
FIG. 9 is a perspectie view of the toy glider of FIG. 8 shown in the form of a toy automobile.

In FIG. 9 glider 1 of FIG. 8 is shown in a perspective view in which nose section 9 is pivoted downward about transverse axis 32 so wheel 11*b* is also in contact with and rollable on a horizontal surface for use as a toy automobile.

The present invention illustrates styling and proportions selected to most clearly demonstrate the functions of the toy. It is obvious that many variations in aesthetic design may be used to produce substantially the same result. For instance, the aesthetic design of the robotic humanoid form shown in the drawings is not to be construed as limiting the scope of the invention to the figure illustrated, but many animal and bird forms may be adapted to the structure of the invention, as well as a virtually unlimited number of inanimate mechanical forms within the scope of the invention and claims.

I claim:

1. A transformable toy glider comprising:

an elongated fuselage having a generally horizontal longitudinal axis when said toy glider is in an attitude of normal flight, a nose section and a tail section having airfoil portions parallel to the longitudinal axis, generally in the horizontal and vertical planes including aft and tip edges, said fuselage including a portion of generally trapezoidal form in a horizontal plane, said trapezoidal portion having its parallel sides comprising parallel planes orthogonal to the longitudinal axis and having non-parallel sides forming wing root fairings comprising non-parallel planes at an angle to the longitudinal axis and adapted for the mounting of respective wings thereon;

a pair of generally planar airfoil wings in the horizontal plane, each having a leading edge and a trailing edge, a span axis and having generally planar wing roots in a vertical plane at an angle to said span axis, said wing roots being pivotally attached the the fuselage in abutment with said wing root fairings.

a first rotational position stop for each of said wings in which the angle of the wing root and the angle of the fuselage wing root fairing are added to orient the span axis of the wings into a generally extended flight position normal to the longitudinal axis of the fuselage and the wing airfoils are in the horizontal plane and parallel to the longitudinal axis; and a second rotational position stop for each of said wings, approximately 180° from said first limit stop position, in which the angle of the wing root and the angle of the fuselage wing root fairing are subtracted to orient the span axis of the wings in a retracted position generally parallel to the longitudinal axis of the fuselage and the wing airfoils are in the horizontal plane and transverse to the longitudinal axis and the leading edges of the wings are adjacent to the fuselage.

2. A toy glider according to claim 1 in which at least one vertical portion of the tail section has a depending tip edge, whereby the glider may be placed on a horizontal surface and is partially supported by said depending tip edge of the tail section.

3. A toy glider according to claim 1 in which the nose section is hingedly attached to the fuselage about a hinge axis in the horizontal plane, said hinge axis transverse to the longitudinal axis of the fuselage, whereby said nose section may be rotated in a downward direction about said hinge axis to depend below the fuselage, and at least one vertical portion of the tail section has a tip edge depending below the fuselage, whereby the glider in a normal horizontal flight attitude may be placed on a horizontal surface and be supported by said depending nose section and said tail empennage.

4. A toy glider according to claim 3 in which each depending vertical tip portion of the tail section and the downwardly rotated hose section have wheels whereby the glider may be rolled on a horizontal surface.

5. A toy glider according to claim 1 in which the aft edges of the vertical and horizontal airfoil portions of the tail section form a plane normal to the longitudinal axis, whereby the glider may be placed on a horizontal surface with the longitudinal axis of the glider being vertical.

6. A toy glider according to claim 5 in which the aft edges of the vertical airfoil portions of the tail section are provided with a plurality of wheels whereby the glider may be rolled on a horizontal surface with the longitudinal axis of the glider being vertical.

7. A toy glider according to claim 1 in which the fuselage is provided with a simulated cabin on an upper surface, and is further provided with simulated boat hull contours on a lower surface.

8. A toy glider according to claim 1 in which the vertical plane tail airfoil portions are in the form of biped humanoid or animal feet.

9. A toy glider according to claim 1 in which the nose section is in the form of a humanoid or animal head.

* * * * *